United States Patent [19]

Cutler

[11] Patent Number: 4,658,695

[45] Date of Patent: Apr. 21, 1987

[54] MULTI-DECKED KEYBOARD FOR MUSICAL INSTRUMENTS

[76] Inventor: Douglas A. Cutler, L7 C3 Brock & Thorah Township, Durham County, R2 Beaverton L0K 1A0 Ontario, Canada

[21] Appl. No.: 776,888

[22] Filed: Sep. 17, 1985

[51] Int. Cl.[4] ..... G10C 3/12

[52] U.S. Cl. ..... 84/424; 84/434; 84/451

[58] Field of Search ..... 84/423–428, 84/451

[56] References Cited

U.S. PATENT DOCUMENTS

| | | | |
|---|---|---|---|
| 1,202,882 | 10/1916 | Nordbo | 84/428 |
| 1,603,676 | 10/1926 | Forster | 84/451 |
| 2,203,569 | 6/1940 | Hammond | 84/425 |
| 2,542,532 | 2/1951 | Jewett et al. | 84/424 |
| 2,785,238 | 3/1957 | Bissonette et al. | 84/423 X |

*Primary Examiner*—Lawrence R. Franklin

[57] ABSTRACT

A multi-decked keyboard for musical instruments has three decks arranged for ease of playing with each hand. The primary deck is substantially a normal piano-like keyboard; the second deck is also substantially a normal piano-like keyboard except that the keys are shortened; and the third deck consists only of shortened white keys. The shortened keys permits a normal hand to reach from the primary to the third decks simultaneously. A specially designed key support system maintains a compact keyboard.

3 Claims, 10 Drawing Figures

MULTI-DECKED KEYBOARD FOR MUSICAL INSTRUMENTS

This invention relates to musical keyboards in general and more specifically to keyboards with a plurality of manuals placed in very close proximity to each other.

This invention is a multi-decked musical keyboard involving a combination of three main decks of keys situated in very close proximity to each other in a downward step-like arrangement with the first and top-most deck being a substantially normal piano-like arrangement of both black and white keys, the second deck also being substantially normal and piano-like except that the front to back distance of its touchplate surface is significantly shortened relative to the same distance in the primary deck, and a third deck that is foreshortened similarily to the second deck but that is composed of white keys only. The drop from one level to the next in the step-like arrangement is optimally minimized so as to in combination with the foreshortened second and third key decks facilitate markedly enhanced one hand simultaneous access to keys on all three decks.

The invention also involves connecting all of the touchplate surfaces in the overall keyboard to an arrangement of parallel lever mechanisms which rest on a terraced arrangement of relatively thin support rails with said levers and said supports being so disposed to facilitate complete independence of actuation in all keys in the overall keyboard with said levers and supports also serving to maintain a piano-like feel in the action. Said levers and said support rails are also designed so as to eliminate unnecessary bulk and complexity in the apparatus. The rear portions of each lever are then individually fitted with a transducer for electro-musical interfacing.

CLARIFICATION OF TERMS

The term "main deck" of keys (or "deck" of keys) for the purpose of this disclosure shall be regarded as a reference to an arrangement of musical keys that utilize for touchplate purposes the entire area made available for touchplate purposes by a continuous horizontal plane along a forward section of a corresponding row of horizontally parallel levers.

For example, a normal arrangement of black and white keys in a piano keyboard may be said to constitute one "main deck" of keys although two different "levels" of keys are involved. This refers to the fact that the white and black keys have upper touchplate surfaces resting on different horizontal planes. In this case however, the black keys in and of themselves will herein not be said to constitute a "main deck" of keys as their touchplate surface areas when considered separately from the white keys do not occupy one continuous and unbroken surface plane along the length of the keyboard.

This invention involves the use of a lower row of white keys only. For the purpose of this disclosure, this row will be thought of as a "main deck" or simply "deck" of keys since its white keys create an unbroken plane of touchplate area along the length of the keyboard thus fully utilizing for touchplate purposes the area made available by the horizontal plane along the forward section of its corresponding row of levers.

The term "multi-decked close proximity keyboard" or "close proximity keyboard" shall hereinafter refer to a multi-decked keyboard where two or more main decks of keys are involved in very close step-like proximity and where the bare minimum spacing or vertical drop exists between the adjacent decks of keys; in other words, when the plane of the upper surface of a depressed white key on an upper deck lies parallel with or only slightly above the plane of the upper surface of an undepressed black key (or in some cases undepressed white key) on an immediately lower deck and where the lower deck is also immediately in front of the upper deck.

Ideally, when the black key of an ordinary musical keyboard is completely depressed, its upper surface should rest on a plane that is even with or only very slightly higher (1/16" to ⅛" for example) than the plane of the upper surface of the undepressed white keys. This arrangement prevents the accidental striking of an adjacent white key when a black key is being actuated by a finger.

When auxiliary key decks are placed in very close step-like proximity in front of a first deck of keys, their undepressed upper surfaces require a similar clearance distance relative to the plane of the upper surface of a depressed white key in the first deck which is immediately above the auxiliary deck. (See FIG. 1*b* x and y.) When this clearance distance between main decks is consistently minimized, it has a direct positive effect on the characteristic of one hand simultaneous access to multiple main decks of keys. This is due to the reduction in distance that the fingers must stretch in order to reach to the auxiliary decks.

Therefore, for the purposes of this disclosure, it is important to distinguish between multi-decked keyboards where this minimum clearance is maintained and those where the distance between adjacent main decks of keys is much greater as in a common double manual organ, for example. Both manuals considered together in a double manualed keyboard of this type are not intended for simultaneous one hand access but rather each hand plays on one manual at a time. The past art relevant to this disclosure includes primarily those designs with the type of very close key deck proximity described earlier.

BACKGROUND

In the early art up until 1924 the patents which include an extra deck or decks of keys in close proximity to each other (such that one hand can simultaneously access multiple key decks), without exception involve coupled actions in which keys of the auxiliary deck or decks are mechanically linked to keys of the primary decks. This early art then, does not anticipate the advantage of complete independence of key actuation on all decks which is a highly desirable characteristic to include in a device of the nature I am describing herein.

Later on however, we see in the prior art beginning in 1924 the inclusion of multi-decked close proximity keyboards that do involve independent actuation in an auxiliary close proximity secondary key deck. However, this stage of the prior art fails to recognize the advantage of significantly shortening the front to back key surface distance in the lower secondary key decks relative to the front to back key surface distance in the primary deck.

In particular this phase of the prior art fails to recognize the importance of foreshortened auxiliary key decks in situations where largely piano-like lever action is maintained throughout a multi-decked keyboard array. Certain keyboards in the prior art have sought to create close proximity arrangements of auxiliary touchplate surfaces in combination with a primary piano keyboard by employing push button or electromechanical switch actions in the auxiliary decks. This is disadvantageous in situations where the feel of a piano-like lever action is desired throughout a multi-decked keyboard array.

In addition to possessing its own advantages such as enhanced one-hand simultaneous access to two main decks of keys, a foreshortened secondary main deck of keys makes the inclusion of a third main deck of keys very practical from the point of view of simultaneous one hand access to the three main decks of keys in the resulting multi-decked keyboard.

The post 1924 phase of the prior art then fails to describe a third main deck of keys in a multi-decked keyboard where close as possible proximity relationships are maintained between all decks and where largely piano-like and independently actuated levers are likewise maintained on all decks throughout a multi-decked keyboard array.

Another weakness of the prior art involves those designs which depart significantly from the normal arrangement of black and white keys. This is problematic in that it necessitates a relearning of scales and patterns and compositions that a musician has spent years memorizing on an ordinary keyboard.

Further incompleteness in the prior art concerns the manner in which the touchplate surfaces are connected to key levers. The use within one continuous structure of multiple rows of straight, largely piano-like wooden key levers (with said rows being motion independent of one another and disposed including appropriate yet minimal spacing in a parallel manner one row above the next), have never been employed in the prior art in conjunction with multiple decks of close proximity largely conventional piano-like touchplate surfaces.

Within the prior art, those inventions with multiple rows of conventional piano-like musical keyboards placed in very close proximity to each other, these said cases have either ignored the structure of the levers entirely or have employed mechanical means of actuation more complicated than or far different from the largely conventional piano-like levers of my invention or as previously mentioned said cases have employed means of coupling the secondary rows to the primary ones.

In the construction of contemporary keyboards for electronic interface, wood is often the preferred material for the construction of the key shanks in cases where an effort is made to replicate a piano-like feel in the action of the keyboard.

While prior art does anticipate the parallel stacking of rows of independent lever mechanisms that are connected to musical touchplate surfaces, the prior art does not anticipate the particular problems that arise when largely piano-like wooden key levers are to be arranged in parallel spaced levels one above the next for use in multi-decked keyboards of a design similar or exact to my own.

In particular, the placement of the stop rails (i.e., the stop means that define the downward extent of the key lever's arch of actuation at the front of the key lever) that are required for each main row of levers is crucial. In general, the closer the stop rail is to the front most point of the key lever, the better. If the stop rail is disposed away from the front of the key lever towards the fulcrum of the key lever, the stop rail has a tendency to act as a second fulcrum, especially when the key surface is struck near its front most point with strong force. This causes undesirable motion in the key lever.

This could be corrected by adapting the structure of the key lever system to include some auxiliary stop means probably disposed on the rearward side of the key lever but potentially contributing unnecessary costs and complications to the construction of the key lever. Even when this correction is made there will be a high amount of stress placed on the point on the key lever where it contacts a stop rail positioned significantly away from the front of the key lever especially when the key surface is struck near its front most point with strong force.

Thus a stop rail disposed away from the front of the key lever will force the manufacturer to take additional precautions in choosing materials strong enough to withstand such conditions of use. Forwardly placed stop rails than are clearly preferred yet this technical consideration has not been adequately addressed in the prior art.

GOALS

The main goal of this invention then is to optimize the degree to which one hand can simultaneously access multiple main decks of independently actuatable keys in a multi-decked (or triple decked as in the disclosure) close proximity keyboard while departing as little as possible from the accepted arrangement of black and white keys, particularly in the primary and secondary decks of keys. The invention also seeks to achieve its above stated primary goal while providing for largely piano-like feel in the action throughout the keyboard array.

In the process of achieving these primary goals, the invention provides for a combination of motion limiting guides and stops that will facilitate a simple and direct arrangment for connecting the touchplate surfaces of a multi-decked close proximity keyboard to long, straight, largely piano-like key levers such that independence of actuation of the key levers is maintained throughout the arrangement. The system is so constructed that forward positioning of the stop rails is applied on all levels and unnecessary complication of construction, as well as unnecessary bulk, are avoided.

In trying to achieve this goal, the invention seeks to combine for the first time, highly desirable characteristics that have hitherto existed separately in the prior art, namely foreshortened second and third key decks in combination with completely independent actuation in those same decks.

Other objects and structural details of the invention will be apparent from the following description when read in conjunction with the accompanying drawings forming part of this specification.

DRAWINGS

FIG. 1*a* is a side view cross section of the invention complete with touchplate surfaces, levers and motion limiting guides and stops.

FIG. 1*b* is a side view cross section of the upper deck of keys showing the extent of motion of a key lever when being actuated.

Figure 1A:
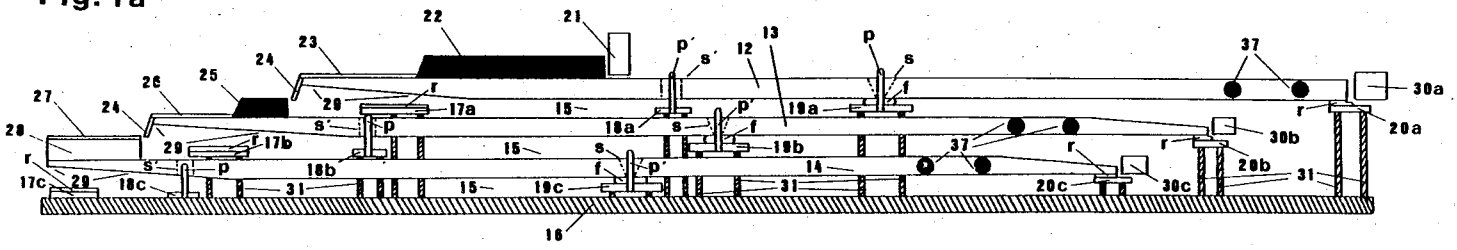

FIGS. 4*a–d* and FIGS. 5*a* and 5*b* display close proximity arrangements of different keyboard sizes in relationship to one hand access.

In describing the preferred embodiment of the invention illustrated in the drawings, specific terminology will be resorted to for sake of clarity. However, it is not intended to be limited to the specific terms so selected and it is to be understood that each specific term includes all technical equivalents which operate in a similar manner to accomplish a similar purpose.

DETAILS

FIG. 1 shows the basic construction of the invention. Key levers top row 12, second row 13, and third row 14 are roughly the same length in all levels to ensure consistency of touch in all main decks of keys. As is usual, the levers attached to the black key touchplates in any given single deck of keys will be slightly shorter than the levers attached to the white keys of that same row of keys to ensure that all levers in that row have a common end point at their rearward portions.

The area 15 between the levels of levers is basically open space which allows room for each lever to move through its arc of actuation without interfacing with any other lever or key surface in the apparatus.

All support rails such as the guide pinrails 18*a*, 18*b*, 18*c*, stop rails 17*a*, 17*b*, 17*c*, balance rails 19*a*, 19*b*, 19*c* and rear rest rails 20*a*, 20*b*, 20*c*, are essentially thin in their vertical depth such that they can be disposed in the spaces between levels of levers in such a way as to ensure lack of interference with the motions of the levers. The thinness of these rails likewise serves to eliminate undo overall height in the apparatus. Stop rails 17*a–c* and rear rest rails 20*a–c* are fitted with strips of felt r to ensure quietness in execution. The levers are only resting on the felt of the rear rest rails 20*a–c* and are not fixed there.

The balance rails 19*a–c* are mounted with a series of pins p corresponding to each of the individual key levers as is customary in piano-like construction. The guide pins p′ are also mounted in a similar manner. Key levers are drilled at their fulcrum point wth a hole and a slot s to accommodate the fulcrum pins as is usual in piano-like structures. Likewise, the key levers are slotted s′ part way towards their forward points to accommodate the guide pins p′ which are mounted on the guide rails and which define the lateral limits of key lever motion as is usual in piano-like structures. Fulcrum pin bases are provided with felts f in the usual manner.

To the left of FIG. 1 is the touchplate area where the primary row of keys both black 22 and white 23 can be seen in relationship to the secondary row of keys both black 25 and white 26. The secondary row is also in relationship to the third row of keys which in this case consists of white keys only 27. The first and second rows of white keys are both fitted with skirts 24.

In FIG. 1*a* 21 shows the rearward limit of the touchplate surface of the upper level of keys. 28 shows a riser section which is individually placed on top of the front part of the lower deck key levers and is included to create proper positioning of the lower level touchplate surfaces relative to the one above. There is ample room at the rear of each key lever to locate rows of transducers 30*a*, 30*b* and 30*c*.

Regrading the beveled cut 29 which occurs on the underside portion of the key levers, this feature serves to reduce the overall height of the apparatus by making it possible to position the levels of key levers closer to one another. If the levers had no beveled cut, the stop rails 17*a–c* would have to be positioned at a point more distantly below the horizontal plane of the underside of the above key lever.

Vertical support struts 31 which are required for the thin motion limiting guide and stop rails are seen, rising up between the key levels from positions secured in the base 16. 37 shows positioning of lead weights at the rearward portions of the levers which provide for counter weight.

Figure 1B:
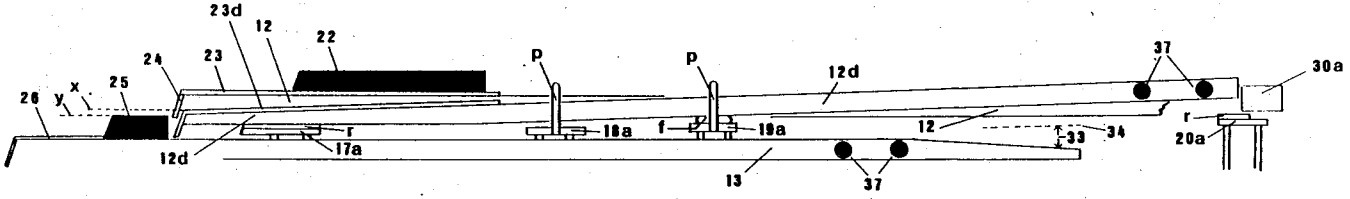

FIG. 1*b* shows the extent of the motion of actuation of the top row key lever 12*d*. The dotted line x shows the horizontal plane of the upper surface of the actuated first row white key 12*d* lying only slightly above the dotted line y which represents the horizontal plane of the upper surface of the underlying and unactuated second row black key. This shows the important minimum clearance distance that exists between the actuated upper surface plane of the white keys of the upper deck and the unactuated rest plane of the upper surface of a black key of the deck of keys immediately below. This of course prevents accidental actuation of adjacent keys between adjacent decks in the course of performing on the instrument. This relationship also exists between the actuated black keys and the unactuated white keys within any given single deck of keys as is usual. All levers in the array will operate in essentially the same fashion as lever 12*d*.

We also see the underside of the front portion of key lever 12*d* with its beveled cut (also seen in FIG. 1*a* 29) contacting the felt r of stop rail 17*a* thus defining the limit of downward motion of the key lever. On the upper side of the rearward portion of the second row lever 13 exists another beveled cut. The distance 33 represents the rearward extent of the arc of actuation of the key lever 13. The dotted line 34 represents the plane on which the upper surface of the rearward portion of the key lever will rest when lever 13 is actuated. The line 34 then is shown to be at a reasonable clearance distance below the lower surface of an unactuated key lever from the primary row of key levers lying directly above. Thus the beveled cut at the rear of key lever 13 serves to ensure against undesirable interference between the various decks of levers when keys are being actuated. The top row of levers 12 does not require a beveled cut at its rearward portion because there is no row of key levers immediately above it.

Figure 2:
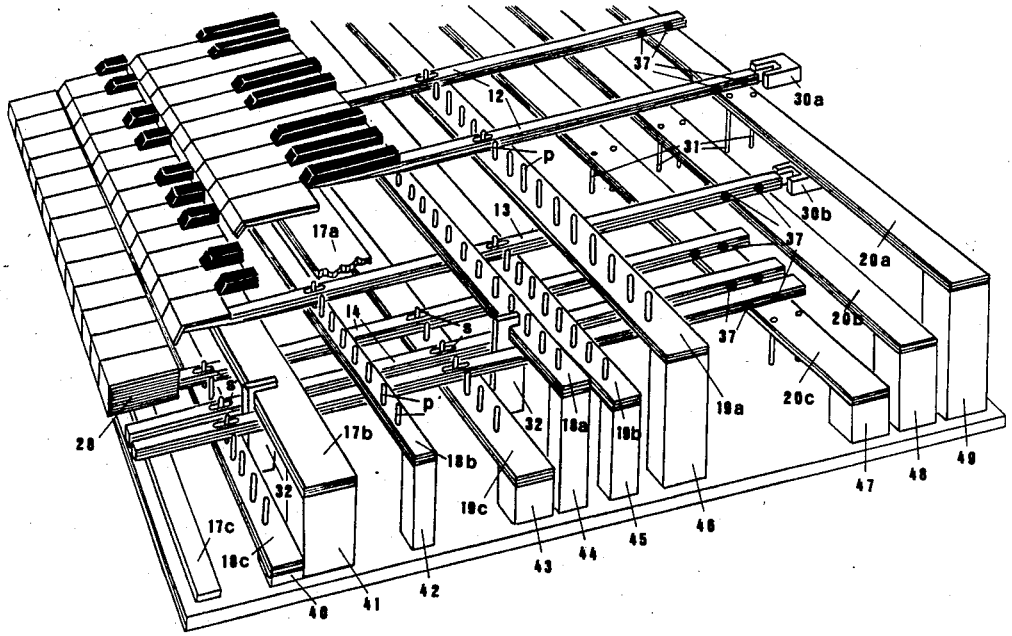
FIG. 2 is a perspective view of the touchplate surface.

FIG. 2 shows a perspective view of the invention with certain sections of key levers from each level removed in order to show the interweaving aspect that exists between the three decks of key levers and their terraced arrangement of support rails. (The designation of parts correlates to FIG. 1.) FIG. 2 demonstrates an important feature of the invention, namely, the manner in which the key levers on different levels are aligned one directly above the other on the vertical in such a way as to allow support struts 31 and 32 to rise up vertically in the spaces between the key levers in order to give support to the rest rails 17*a–c*, guide rails 18*a–c*, balance rails 19*a–c* and rear rails 20*a–c*, which because of their thinness require support.

Figure 3:
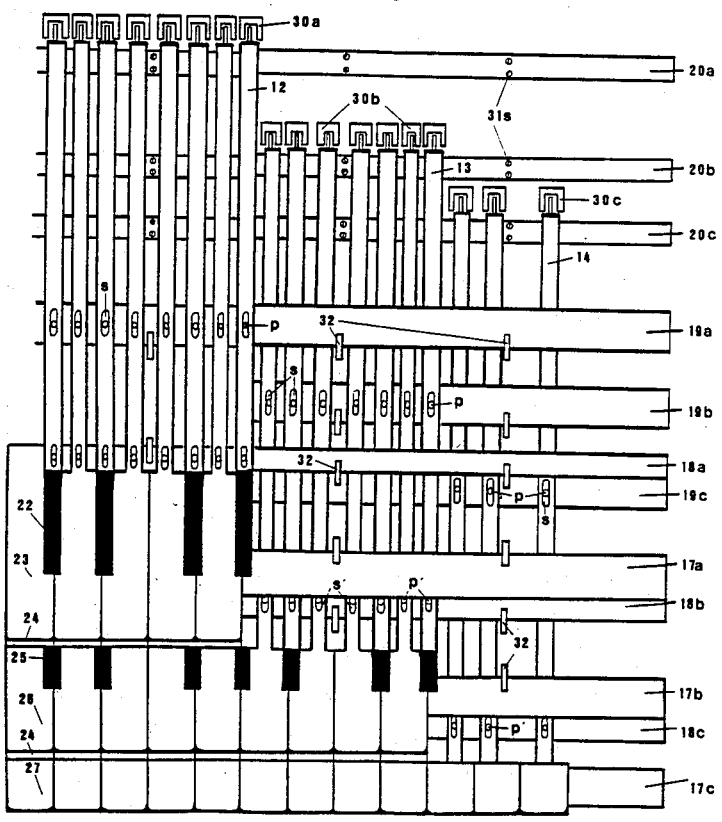
FIG. 3 is a top view of the apparatus.

FIG. 3 which is a top view of the invention shows notched pieces 32 firmly fixed to base 16 and rising up vertically through the spaces between the key levers. This along with the long metal support bars 31 show two different ways of approaching support for the rails. Ideally, the rails should be supported every few inches.

In operation, the overall structure allows all of the keys on all levels to individually move through a normal piano-like key dip upon actuation without interfering with any other lever in the apparatus and to then trigger a transducer for electro-musical interface. The proper placement of felts ensures against unnecessary noise upon actuation.

The main advantage of the invention over the prior art is that it much more completely develops and addresses the characteristics of one hand simultaneous access to multiple main decks of independently actuatable keys in a close proximity multi-decked keyboard with largely conventional piano-like keys. In combination with an appropriate electro-musical interface, a keyboard such as herein disclosed can achieve instant and near instant access to a greatly expanded range of independent pitch possibilities.

For example, note values of very high or very low pitch can be assigned to the auxiliary levels in the mid range of the keyboard. Ordinarily, these pitch values are assigned to the extreme ends of a normal linear keyboard and the performer must often move his or her arm two feet or more in order to actuate these pitches when moving from the mid range.

In the situation described above access to these extreme pitch values can be accomplished without difficult arm motions or even without any arm motion at all. Other possibilities for pitch reassignement can be realized on the auxiliary decks as well that could for example render extremely easy the execution by a single hand of consecutive elevenths, twelfths, even nineteenths, or higher intervals.

A keyboard of the type described in the pre-1924 art, because of its coupled action, would be unable to facilitate such a situation without interfering with the normal chromatic pitch configuration in the primary row. In other words auxiliary decks of keys mechanically linked to a primary deck provide only a new second location for playing an already existing note possibility and do not provide for a new note possibility. Altering the normal arrangement in the primary decks is undersirable because it can be extremely confusing to the performer.

In relationship to the post-1924 prior art, the invention herein disclosed represents an advance both in its inclusion of a significantly shortened second main deck of keys and by its inclusion of a third main deck of keys immediately below the second.

The particular advantage of shortening the front to back distance of the key surfaces of the secondary deck or decks relative to a normal size primary deck and in particular the advantages of thus shortening the black keys of the auxiliary deck or decks of keys in this: the ease with which a single hand can simultaneously access multiple main decks of key surfaces is greatly enhanced.

This enhancement happens for two main reasons:

1. The improved positioning of the white keys in the secondary decks relative to the thumbs (as well as other fingers).

In a normally arranged keyboard of white keys with elevated black keys, it is desirable and usual to strike the white keys in their full faced area away from the white key areas which fall between the elevated black keys since the area of accurate strike zone is much greater in the full faced area. This is especially true in the case of the thumb which is very fat on a normal keyboard and almost never strikes those portions of white keys that lie between two adjacent black keys.

Now it is the thumb in particular that seems to be most amenable in its placement on the hand for use in actuating auxiliary key decks immediately below the primary one. The thumb can comfortably be free to do so while the remaining fingers of its hand remain in contact with the primary deck. Yet the thumb, due to its great thickness, has extreme difficulty actuating white keys from a position between the raised black keys (as described above). When the overall front to back distance of the keys and particularly the black keys of the secondary keyboard are shortened, the area of full faced white keys is brought much closer to the front of the primary deck of keys. The advantage of reducing the length of the black notes of the secondary deck or decks should be apparent since the thumb much prefers the open faced white key areas and can much more readily and efficiently actuate these in such an arrangement. Other fingers of the hand, although better able to actuate those portions of white keys that occur between the raised black keys than the thumb, still more easily access the open faced areas of white keys and benefit similarly to the thumb from significantly foreshortened keys in the secondary deck.

2. The practicality of a third main deck of keys.

The foreshortening of the secondary keyboard enables the addition of the third deck of keys in such a way that one hand alone can simultaneously access keys on all three decks even while maintaining contact with the black keys of the primary deck. This situation further expands the number of independent pitch possibilities that can be instantaneously accessed by the musician's hand.

FIG. 4*a–d* and 5*a–b* demonstrate these considerations.

Figure 4A:
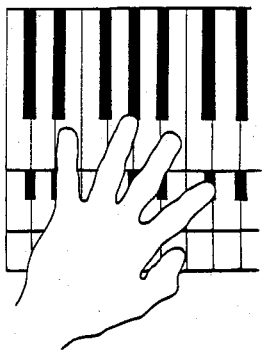

In FIG. 4*a* we see a hand simultaneously accesing keys on three main decks of keys in a keyboard of the invention herein disclosed. The hand can do so without any extreme stretching or discomfort. Note that the ring finger is still maintaining contact with a black key of the primary deck while the thumb still easily reaches the third main deck of rays.

Figure 4B:
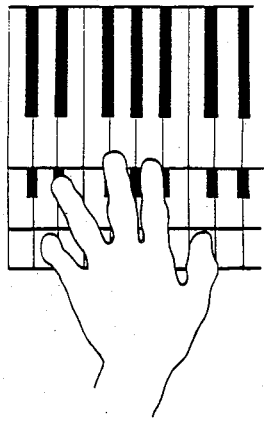

FIG. 4*b* shows a similar situation to FIG. 4*a* except that here the thumb and little finger are both easily accessing keys on the third deck while the other fingers of the hand maintain contact with the white keys of the primary and secondary decks.

Figure 4C:
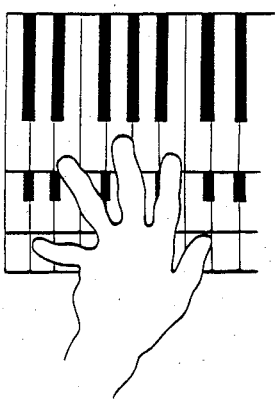

FIG. 4*c* shows a similar situation to FIG. 4*b* except that with a bit of extra but not uncomfortable stretching the ring and little fingers of the same hand can extend from the primary deck to the third deck respectively.

Figure 4D:
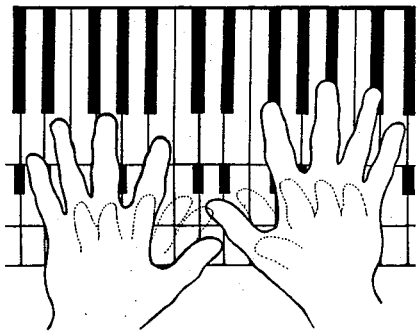

FIG. 4*d* shows two hand actuating the keys of the invention. The dotted line show the positions that can be easily and comfortably accessed by the thumbs while the remaining fingers access the primary level of keys only.

It is seen how easily the thumbs can reach the preferable full faced portion of a variety of white keys of the secondary deck and how easily the maneuverable thumbs can also reach to the white keys of the third main deck.

Figure 5A:
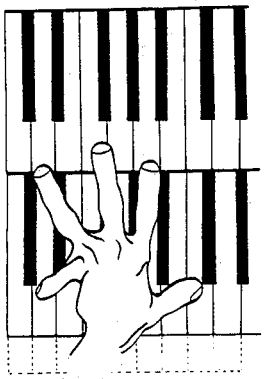
Figure 5B:
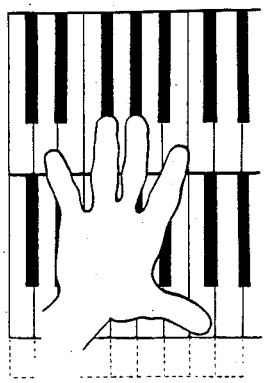

FIG. 5*a* and FIG. 5*b* show a close proximity arrangement of two main decks of keys where the secondary deck has not been foreshortened. It can be seen how much more awkward or even impossible it is for the hand to duplicate the type of accessing of keys that is possible with a keyboard of the invention as shown in FIG. 4*a–d*.

In FIG. 5*a*, for example, the ring and little finger are seen extending from the white key of the primary deck to the full faced portion of the white keys of the secondary deck respectively. This is, however, a very difficult stretch for an average size hand. And further, when the secondary deck is not foreshortened, it is impossible for a normal hand to span the first and third decks with its ring and little finger as was shown in FIG. 4*c*.

FIG. 5*a* also shows the impossibility of a normal size hand accessing the keys of a third close proximity deck (represented by the dotted lines) with its thumb and little finger while still maintaining primary deck white key contact with its other fingers as was the case in FIG. 4*b*.

FIG. 5*b* shows the thumb of a hand accessing the full faced portion of a white key of the secondary deck while the ring finger still maintains contact with a black key of the primary deck. This is accomplished only with a full extension of the thumb. It shows the extreme difficulty or impossibility in this type of arrangement of accessing a third main deck of keys with the thumb while contact with the black keys of the primary deck is still maintained as is the case in FIG. 4*a*.

ADVANTAGES

The invention herein disclosed then represents the first occasion in the art of multi-decked close proximity keyboards with largely conventional piano-like keys, of combining independent actuation of all levels with significantly shortened auxiliary key decks. It combines two highly desirable characteristics that have hitherto existed separately in the prior art. It is a recombination of known elements producing a novel and synergistic result. In its preferred embodiment, my invention is clearly the first occasion for three independently actuatable decks of largely piano-like keys to be placed in close proximity to each other such that one hand can simultaneously actuate notes on all three decks. From the musicians point of view, a keyboard of this nature will allow him or her to easily explore musical possibilities such as chord voicings and melodic sequences that would be both difficult and impossible to duplicate with any other keyboard in the prior art.

In addition, the invention lays out a simple, direct and efficient means of arranging the lever mechanisms and their corresponding motion limiting guides and stops in such a keyboard in order to facilitate its specified function. It does so while minimizing the overall height of the keyboard structure so by including the terraced arrangements of thin support rails in combination with beveled front under-portions in the key levers.

The prior art is accustomed to employing very thick and solid structures as support means for motion limiting guides and stops. In the invention herein disclosed as in other keyboards, strength and stability in the support means, especially in the frontward stop means, is essential since these structures must be able to absorb certain amounts of force.

Relatively thin support rails are required for the design of the invention herein disclosed in order to avoid awkward height and bulk that would occur if the common prior art practice of using thick and solid support means were resorted to. The invention is novel in its use of thin support struts rising up between the key levers to act as support for the horizontally disposed motion limiting guide and stop rails. Thus economy of space and weight is maintained without sacrificing strength. The invention further accomplishes its specified function in a way that is both novel and superior to the prior art, particulary in its attention paid to the forward positioning of the stop rails.

It is to be understood that the form of the invention herewith shown and described is to be taken as a preferred embodiment. Various changes may be made in the shape size and arrangement of parts. For example: Equivalent elements may be substituted for those illustrated and described herein, parts may be reversed and certain features of the invention may be utilized independently of the use of other features all without departing from the spirit or scope of the invention as defined in the subjoining claims.

I claim:

1. Multiple rows of long, straight, consecutively spaced multiple key levers, each of said rows lying horizontally and being positioned one above the other in a parallel manner at a distance from each other that allows for each lever to perform unhindered and independent motions of usual piano-like actuation, a step-like, terraced arrangement of long thin rails acting as motion limiting guides and stops for said arrangement of key levers with said rails being thin enough to be unobtrusively positioned with respect to the motion of actuation of said levers in the horizontal spaces between the levels of said key levers, vertically disposed thin support struts occupying the vertically aligned spaces between vertically corresponding key levers on different rows of levers and acting as bases for said terraced arrangement of long, thin motion limiting guide and stop rails, in combination with a multi-decked musical keyboard that itself combines a substantially normal piano-like primary row of keys, a second row of substantially normal piano-like keys except that the front to back distances of all key surfaces, and in particular the front to back distance of the black key surfaces of said second row of keys, are significantly shortened relative to the front to back distance of said primary row of key surfaces, said second row of keys being positioned in a downward step-like manner immediately in front of said primary row of keys such that when a white key of said primary row of keys is in a completely depressed or actuated position, its upper surface rests on a plane which is extremely close to or immediately level with the plane of the upper surface of the unactuated black keys of said second row of keys, a third row of significantly shortened white keys only positioned in a downward step-like manner directly in front of said second row of keys such that when a white key of said second row of keys is in a completely actuated position its upper surface rests on a plane which is slightly above or level with the plane of the upper surface of an undepressed white key of said third row of keys, and a transducer individually connected to the rearward portion of each lever.

2. In a multi-decked musical keyboard, the combination of a substantially normal piano-like primary row of keys, a second row of substantially normal piano-like keys except that the front to back distances of all key surfaces of said second row of keys are significantly shortened relative to the front to back distance of said primary row of key surfaces, said second row of keys being positioned in a downward step-like manner immediately in front of said row of keys such that when a white key of said primary row of keys is in a completely depressed or actuated position, its upper surface rests on a plane which is extremely close to or immediately level with the plane of the upper surface of the unactuated black keys of said second row of keys, a third row of white keys only which are shortened similarly to the white keys of said second row of keys, said third row of keys being positioned in a downward step-like manner directly in front of said second row of keys such that when a white key of said second row of keys is in a completely actuated position, its upper surface rests on a plane which is slightly above or level with the plane of the upper surface of an undepressed white key of said third row of keys, a system of parallel levers connected individually to the key surfaces of said primary, second, and third rows of keys such that completely independent actuation of all key surfaces on all levels is facilitated, and a transducer individually connected to the rearward portion of each lever.

3. Multiple rows of long, straight, consecutively spaced multiple key levers, each of said rows lying horizontally and being positioned one above the other in a parallel manner at a distance from each other that allows for each lever to perform unlinked and independent motions of actuation, a step-like, terraced arrangement of long, thin rails acting as motion limiting guides and stops for said arrangement of key levers with said rails being thin enough to be unobtrusively positioned with respect to the motion of usual piano-like actuation of said levers in the horizontal spaces between the levels of said key levers, in combination with a multi-decked musical keyboard that itself combines a substantially normal piano-like primary row of keys, a second row of substantially normal piano-like keys except that the front to back distances of all key surfaces, and in particular the front to back distance of the black key surfaces of said second row of keys, are significantly shortened relative to the front to back distance of said primary row of key surfaces, said second row of keys being positioned in a downward step-like manner immediately in front of said primary row of keys such that when a white key of said primary row of keys is in a completely depressed or actuated position, its upper surface rests on a plane which is extremely close to or immediately level with the plane of the upper surface of the unactuated black keys of said second row of keys, a third row of significantly shortened white keys only positioned in a downward step-like manner directly in front of said second row of keys such that when a white key of said second row of keys is in a completely actuated position, its upper surface rests on a plane which is slightly above or level with the plane of the upper surface of an undepressed white key of said third row of keys, and a transducer individually connected to the rearward portion of each lever.

* * * * *